US007525402B2

(12) United States Patent
Gao

(10) Patent No.: US 7,525,402 B2
(45) Date of Patent: Apr. 28, 2009

(54) CIRCUIT INTERRUPTION DEVICE WITH INDICATOR HAVING FUNCTION OF AUTO-MONITORING AND MULTI-PROTECTING CIRCUIT

(75) Inventor: Shaohua Gao, Yueqing (CN)

(73) Assignee: Wenzhou Trimone Science and Technology Electric Co., Ltd. (CN)

( * ) Notice: Subject to any disclaimer, the term of this patent is extended or adjusted under 35 U.S.C. 154(b) by 0 days.

(21) Appl. No.: 11/655,322

(22) Filed: Jan. 18, 2007

(65) Prior Publication Data

US 2007/0229202 A1 Oct. 4, 2007

(30) Foreign Application Priority Data

Apr. 3, 2006 (CN) ..... 2006 1 0025417

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 73/12*** | (2006.01) |
| ***H01H 73/00*** | (2006.01) |
| ***H01H 83/06*** | (2006.01) |

(52) U.S. Cl. ..... 335/18; 335/6

(58) Field of Classification Search ..... 335/18, 335/78, 113, 167–172, 253–254; 361/42–51
See application file for complete search history.

(56) References Cited

U.S. PATENT DOCUMENTS

| | | | | |
|---|---|---|---|---|
| 3,016,435 | A * | 1/1962 | Schwartz | 335/18 |
| 4,078,219 | A * | 3/1978 | Hodgson | 335/167 |
| 5,459,630 | A | 10/1995 | MacKenzie et al. | |
| 5,517,165 | A * | 5/1996 | Cook | 335/18 |
| 5,990,769 | A * | 11/1999 | Tam | 335/18 |
| 6,052,266 | A | 4/2000 | Aromin | |
| 6,437,700 | B1 * | 8/2002 | Herzfeld et al. | 340/650 |
| 6,515,564 | B2 * | 2/2003 | Leopold et al. | 335/18 |
| 6,674,289 | B2 | 1/2004 | Macbeth | |
| 6,946,935 | B2 * | 9/2005 | Wu et al. | 335/18 |
| 6,952,150 | B2 | 10/2005 | Radosavljevic et al. | |

(Continued)

FOREIGN PATENT DOCUMENTS

CN 1106957 A 8/1995

(Continued)

OTHER PUBLICATIONS

RV4145A, Low Power Ground Fault Interrupter, Product Specification, 2002 Fairchild Semiconductor Corporation, www.fairchildsemi.com, Mar. 6, 2002, 11 pages.

*Primary Examiner*—Elvin G Enad
*Assistant Examiner*—Alexander Talpalatskiy
(74) *Attorney, Agent, or Firm*—Perkins Coie LLP; Manni Li

(57) ABSTRACT

A circuit interruption device having an input for receiving AC power, an AC socket electrically connected to the power input, a reset switch electrically coupling the power source to the AC socket, a controller coupled to the power input, a stationary electromagnet connected to the controller, an electronic switch connected to the electromagnet and the controller, a pivotally mounted permanent magnet adapted to move between a first position apart from the electromagnet and a second position in contact with the electromagnet, and a mechanical connection connecting the pivotally mounted permanent magnet to the reset button.

15 Claims, 15 Drawing Sheets

U.S. PATENT DOCUMENTS

| | | | | |
|---|---|---|---|---|
| 6,998,945 | B2 * | 2/2006 | Huang et al. | 335/18 |
| 7,164,564 | B1 | 1/2007 | Finlay et al. | |
| 7,307,821 | B2 * | 12/2007 | Wang | 361/42 |
| 2004/0021996 | A1 * | 2/2004 | Wu et al. | 361/42 |
| 2004/0070897 | A1 * | 4/2004 | Wu et al. | 361/42 |
| 2005/0012575 | A1 * | 1/2005 | Huang et al. | 335/18 |
| 2007/0132530 | A1 * | 6/2007 | Wang | 335/6 |
| 2007/0188276 | A1 * | 8/2007 | Shi | 335/6 |

FOREIGN PATENT DOCUMENTS

| | | | |
|---|---|---|---|
| CN | 1819097 | A | 8/2006 |

* cited by examiner

CIRCUIT INTERRUPTION DEVICE WITH INDICATOR HAVING FUNCTION OF AUTO-MONITORING AND MULTI-PROTECTING CIRCUIT

CROSS-REFERENCE TO RELATED APPLICATIONS

This application claims priority from Application 200610025417.9 filed in China on Apr. 3, 2006. The disclosure of the foregoing application is incorporated herein by reference.

FIELD OF THE INVENTION

The present invention relates to a circuit interruption device with indicator having an auto-monitoring and multi-protecting circuit. The invention particularly relates to a ground fault circuit interrupter (GFCI), arc fault circuit interrupter(AFCI), appliance leakage current interrupter (ALCI), leakage current detection interrupter (LCDI) plugs or receptacles and solenoid mechanisms. Especially, the present invention has an indicator to provide alarm indication and also it automatically monitors the operational condition of the circuit interrupter and electrical circuit of the protective device.

BACKGROUND OF THE INVENTION

The invention relates to a Ground Fault Circuit Interrupter (GFCI), which in general, is technically well known. A GFCI is designed to protect the user from electrocution when a hazardous ground fault occurs. Household electrical appliances, home bathrooms and kitchens are typically required to be equipped with electrical circuits having a ground fault protection function.

GFCIs are described in several U.S. Patents. In these devices the power supply is immediately cut off when some of the operating components are damaged. This prevents the power supply from connecting to the line terminal via a load terminal if the GFCI is reversely miswired.

Such devices, however, have several disadvantages. First, when the device trips and cuts the power supply in instances where some of the operating components are damaged, power continues to be supplied to all the components on the circuit board. In addition, the device can still be reset by depressing the reset button, thus enabling unprotected power to reach the device. Particularly, these devices have no ability to trip when the solenoid coil burns. All of these flaws result in unprotected power being permanently supplied to the circuit board even when the GFCI is not operating or is in a tripped state.

Second, as described in many U.S. patents, if the line-load is miswired during installation, the device prevents the power supply from flowing to the line terminal via the load terminal and is non-resettable, but the power supply still exists at the openings of the receptacle face.

Third, if a GFCI reaches its end of life, and should be replaced, the prior art only employs a ground fault simulated fault test circuit which lacks end-of-life simulated fault monitoring to provide an alarm indication.

In the abovementioned cases, the safety of the GFCI circuit device is not ensured, and the users are misled to use unprotected power.

SUMMARY OF THE INVENTION

An object of the present invention is to provide a novel, improved device with a dual-color alarm indication lamp and a circuit auto-monitoring function, to thereby stop the use of unprotected power.

Another object of the invention is to provide an auto-monitoring protective circuit coupled to a solenoid contained within the power interruption circuit which is located within a GFCI, AFCI, ALCI, or LCDI plug or receptacle.

An embodiment of the invention is configured to monitor the operational condition of the circuit and to trip a solenoid interruption mechanism if one or more components in the circuit result in open or short circuit and fault signal occurrences due to aging or reaching the end of components life. An embodiment of the device also makes the interruption mechanism trip if external power-failure occurs and prevents the GFCI, AFCI, ALCI, or LCDI plug or receptacle from being reset until it is safe to do so.

The above and other objects are accomplished according to the invention by the provision of a circuit interruption device, which in one embodiment, comprises: an input for receiving AC power; an AC socket electrically coupled to the power input; a reset switch having an open and a closed position, which electrically couples the power source to the AC socket, the reset switch including a reset button to move the reset switch between the open and closed positions, the reset switch being biased in the open position; a controller, coupled to the power input, and producing an output voltage in response to a change in current at the power input; a stationary electromagnet coupled to the input and to the controller; an electronic switch connected to the electromagnet and the controller which can receive the output voltage from the controller and turn off the electromagnet; a pivotally mounted permanent magnet having a first and a second position, the first position of the pivotally mounted magnet being apart from the electromagnet, the second position of the pivotally mounted magnet being in contact with the electromagnet, the pivotally mounted magnet being placed into the first position or the second in response to the presence or absence of a magnetic field generated by the electromagnet; and a mechanical connection connecting the pivotally mounted permanent magnet to the reset button such that the permanent magnet's first position corresponds to the reset switch's open position and the permanent magnet's second position corresponds to the reset switch's closed position.

In another embodiment of the invention, the electromagnet is in the form of a solenoid comprising a solenoid bobbin and a plunger passing through the hollow core of the bobbin and riveted to a fixed magnet on the back of the solenoid. With current flowing through the solenoid bobbin from the power input, the solenoid functions as an electromagnet. As a result, the plunger produces magnetic force so that the pivotally mounted permanent is caught with the magnetic force of the solenoid and held against the plunger. If no current flows through the power input, the solenoid releases automatically, enabling the pivotally mounted permanent magnet to return to the original position. As a result, if the solenoid is damaged, the device trips automatically to cut off the power supply.

In another embodiment, an auxiliary switch is turned off automatically to cut the power supply to all components in the interruption device when the device trips, thus prolonging the operational life of the circuit and all the components of the device.

Further embodiments, features and advantages of the invention will become apparent from the following detailed description when considered in conjunction with the accompanying drawings.

DETAILED DESCRIPTION

Figure 1:
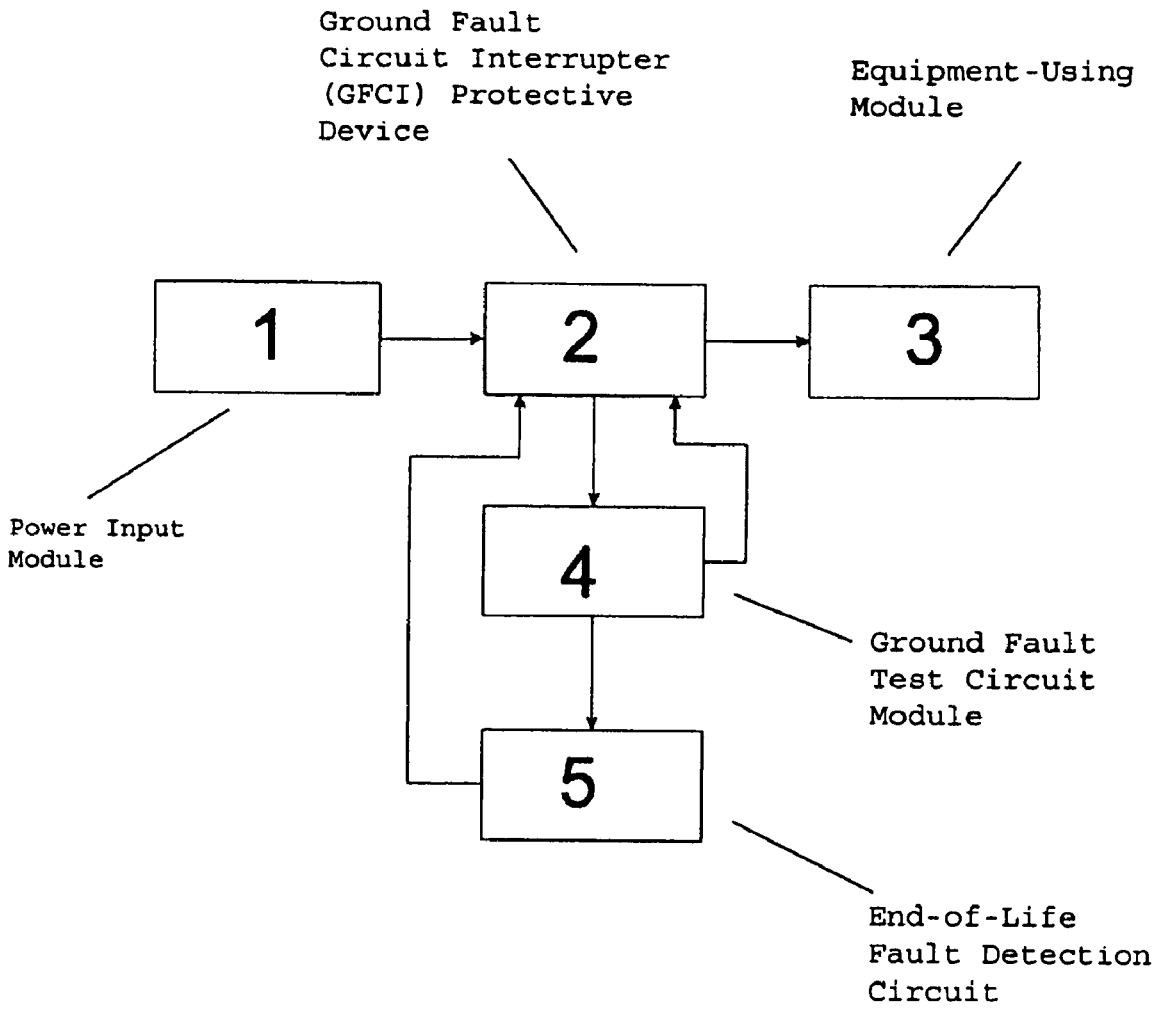
FIG. 1 is an overall block diagram of one embodiment of the present invention.

FIG. 1 is an overall block diagram of one embodiment of the present invention consisting of five main components: a power input module (1), a Ground Fault Circuit Interrupter (GFCI) protective device (2), an equipment-using module (3), a ground fault test circuit module (4) and an end-of-life fault detection circuit (5).

The output terminal of the power input module (1) is coupled to the input terminal of GFCI protective device (2). The load terminal of the ground fault circuit interrupter (GFCI) protective device (2) is coupled to the input terminal of equipment-using module (3). The load terminal of ground fault circuit interrupter (GFCI) protective device (2) is coupled to the input terminal of a ground fault test circuit module (4). The output terminals of ground fault test circuit module (4) is connected to the input terminal of the end-of-life fault detection circuit (5), and an output terminal of the ground fault test circuit module(4) and end-of-life detection circuit (5) are coupled to the input terminal of ground fault circuit interrupter GFCI protective device (2).

Figure 2:
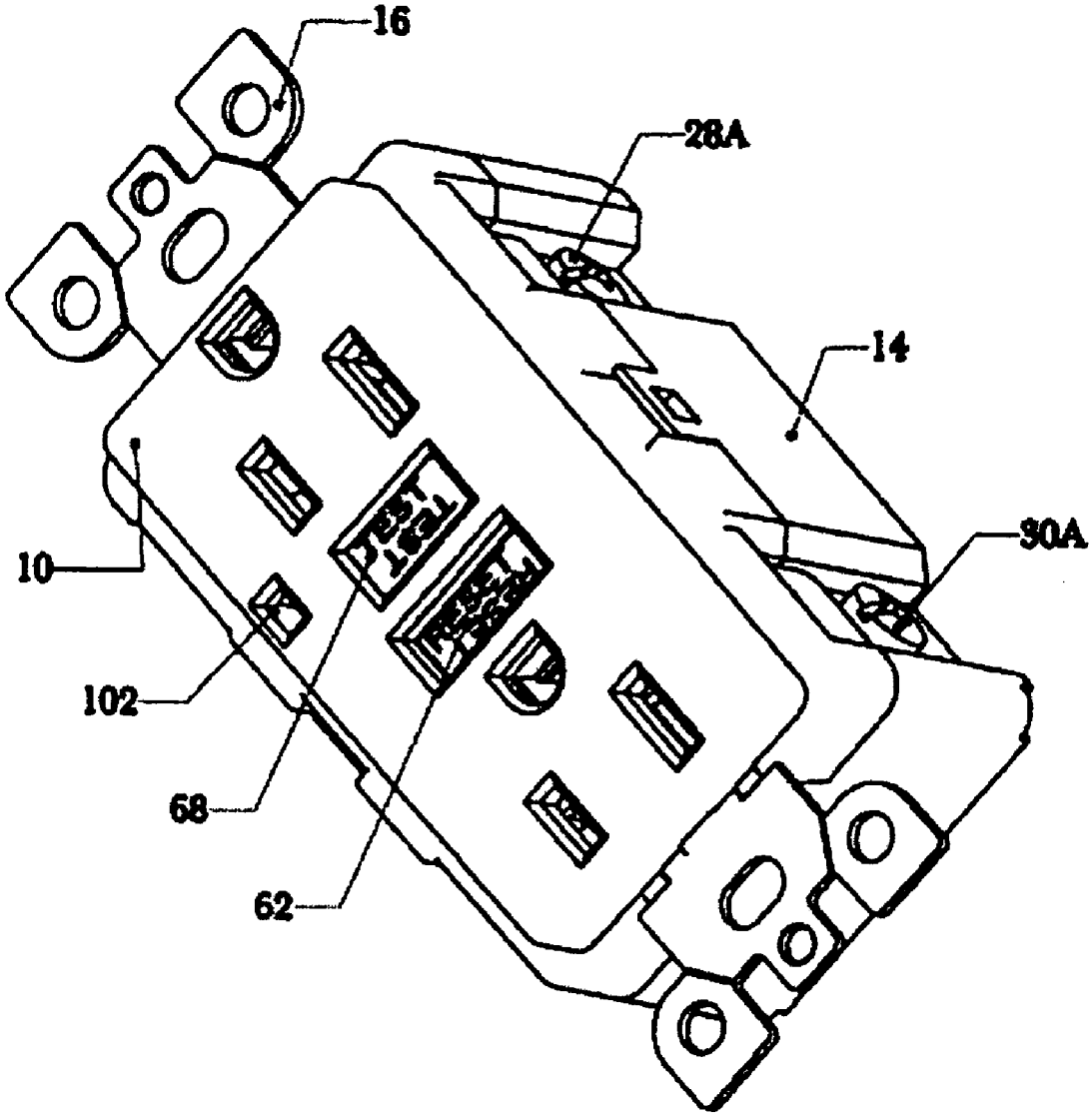
FIG. 2 is a front bottom right perspective view of a GFCI according to one embodiment of the present invention.
Figure 3:
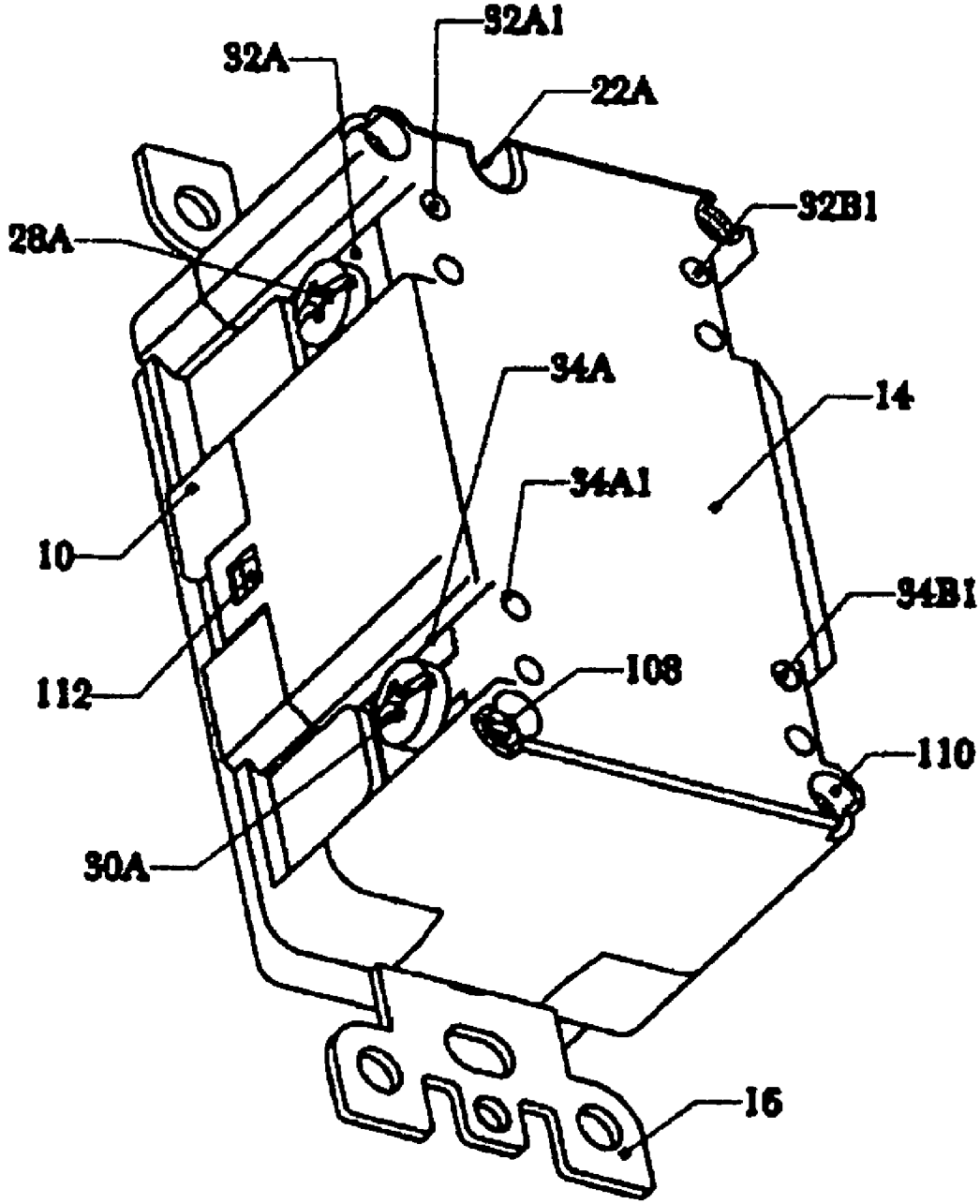
FIG. 3 is a rear, bottom right view of a GFCI shown in FIG. 1.

FIGS. 2 and 3 show perspective views of a complete circuit interruption device according to one embodiment of the present invention consisting of a face cover (10), a back cover (14) and a middle frame (12) (see FIG. 4) on which a grounding strap (16) is placed. All the parts are assembled together by four assembly screws (not shown) at the four corners (108) of the back cover (14).

The face cover (10) consists of a reset button (62) extending from the surface, a test button (68) and a dual-color indication lamp (102). The dual-color indication lamp (102) glows green if the circuit interrupter is reset and operating under normal conditions. If the test button (68) is depressed to perform a simulated fault detection and the device trips normally, the green lamp goes out and the electronic components are de-energized. If the simulated fault detection fails, or the device fails to trip altogether, dual-color indication lamp (102) turns from green to red to communicate to the user that the GFCI has reached the end of life and can not be further used.

FIG. 3 is an outside bottom view of a GFCI. It shows four line terminal push-in wiring apertures (32A1),(32B1) configured at both sides of the upper portion of the back cover (14). A ground wiring aperture (22A) is configured in the middle. Four load terminal push-in wiring apertures (34A1),(34B1) are configured at both sides of the lower portion of the back cover (14). Four assembly screw apertures (110) are configured at the four corners on the back cover (14).

Figure 4:
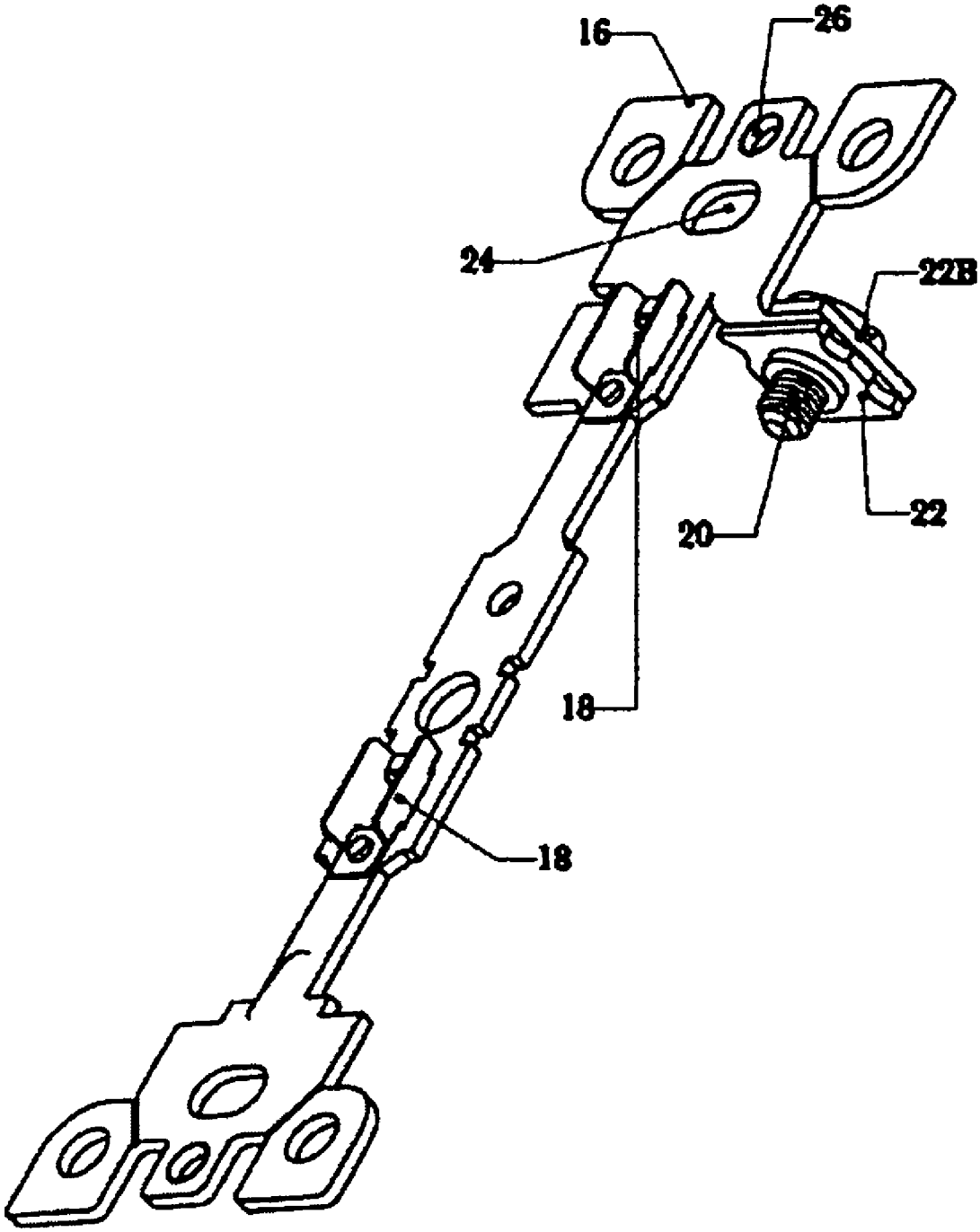
FIG. 4 is a perspective view of a grounding strap depicted in FIG. 2.

FIG. 4 is a perspective view of the grounding strap of the GFCI. It shows two ground depending tabs (18) disposed on the grounding strap (16). A ground screw (20) is secured to the ground nut (22) after passing through a ground wiring lug (22B). Two mounting apertures (24) in the grounding strap (16) are configured to mount the GFCI to a wall junction box. Two face cover mounting screw apertures (26) are configured to secure the decorating face cover of the GFCI.

Figure 5:
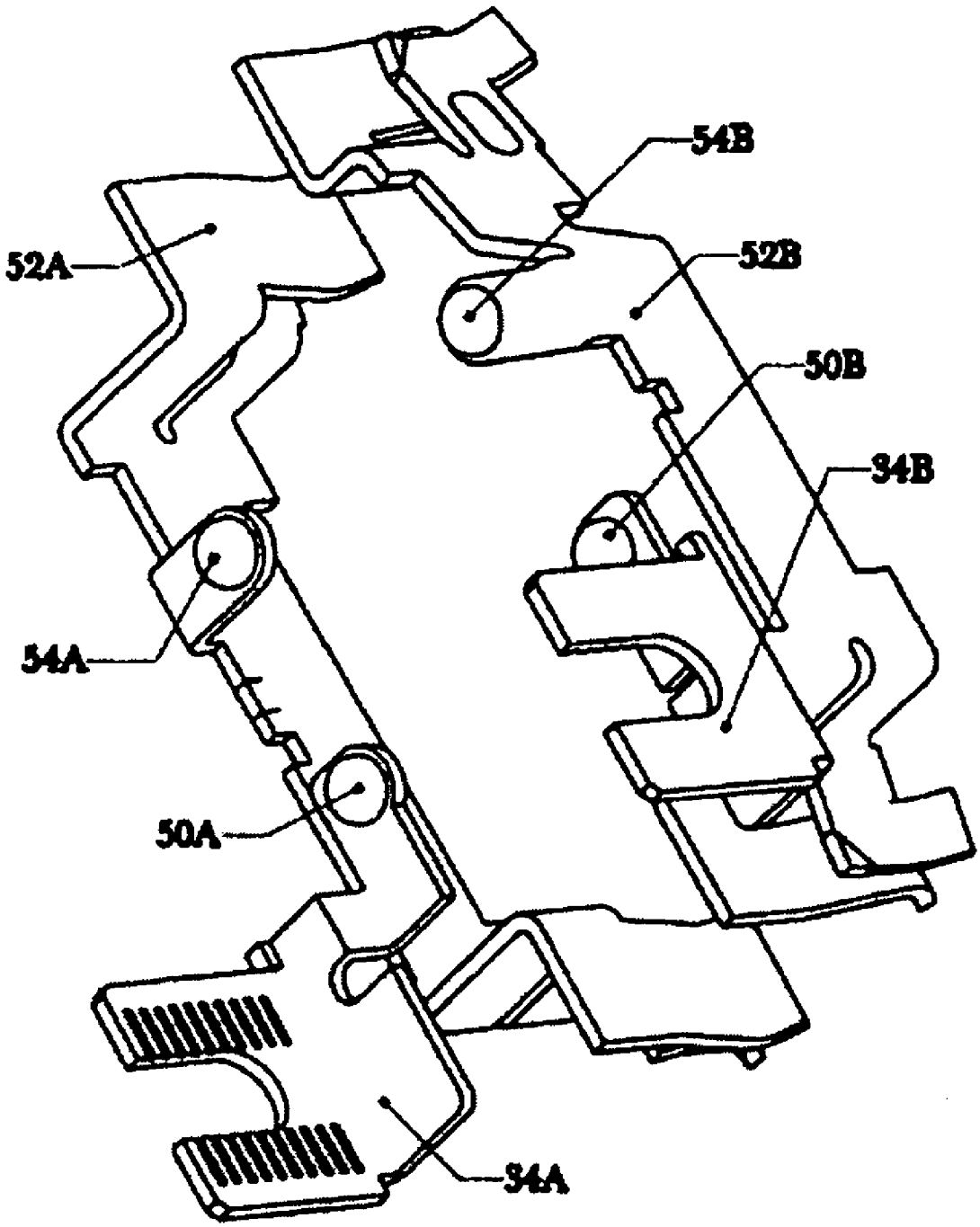
FIG. 5 is a schematic of the load contact-frame and the load conductive member depicted in FIG. 2.

FIG. 5 is an assembly schematic of the inner structure of the device depicted in FIG. 2. It contains a neutral contact-frame (52A), a phase contact-frame (52B), and the pair of load conductive-members (34A),(34B) The load neutral contact-frame (52A) and the load phase contact-frame (52B) are disposed, from left to right, under the face cover (10) (see FIG. 2) and on the middle frame 12 (see FIG. 7). The pair of load conductive members (34A),(34B) are disposed between the back cover (14) (see FIG. 3) and the middle frame (12), opposite to the undersides of load contact-frame (52A) and phase contact-frame (52B), respectively, but separated by the middle frame (12) and do not contact one another, thus preventing a line-load miswiring fault. A first load fixed contact (54A) and a second load fixed contact (54B) are disposed on the load neutral contact-frame (52A) and the phase contact-frame (52B) respectively. A first load fixed contact (50A) and a second load fixed contact (50B) are disposed on the pair of load conductive members (34A),(34B) respectively.

Figure 6:
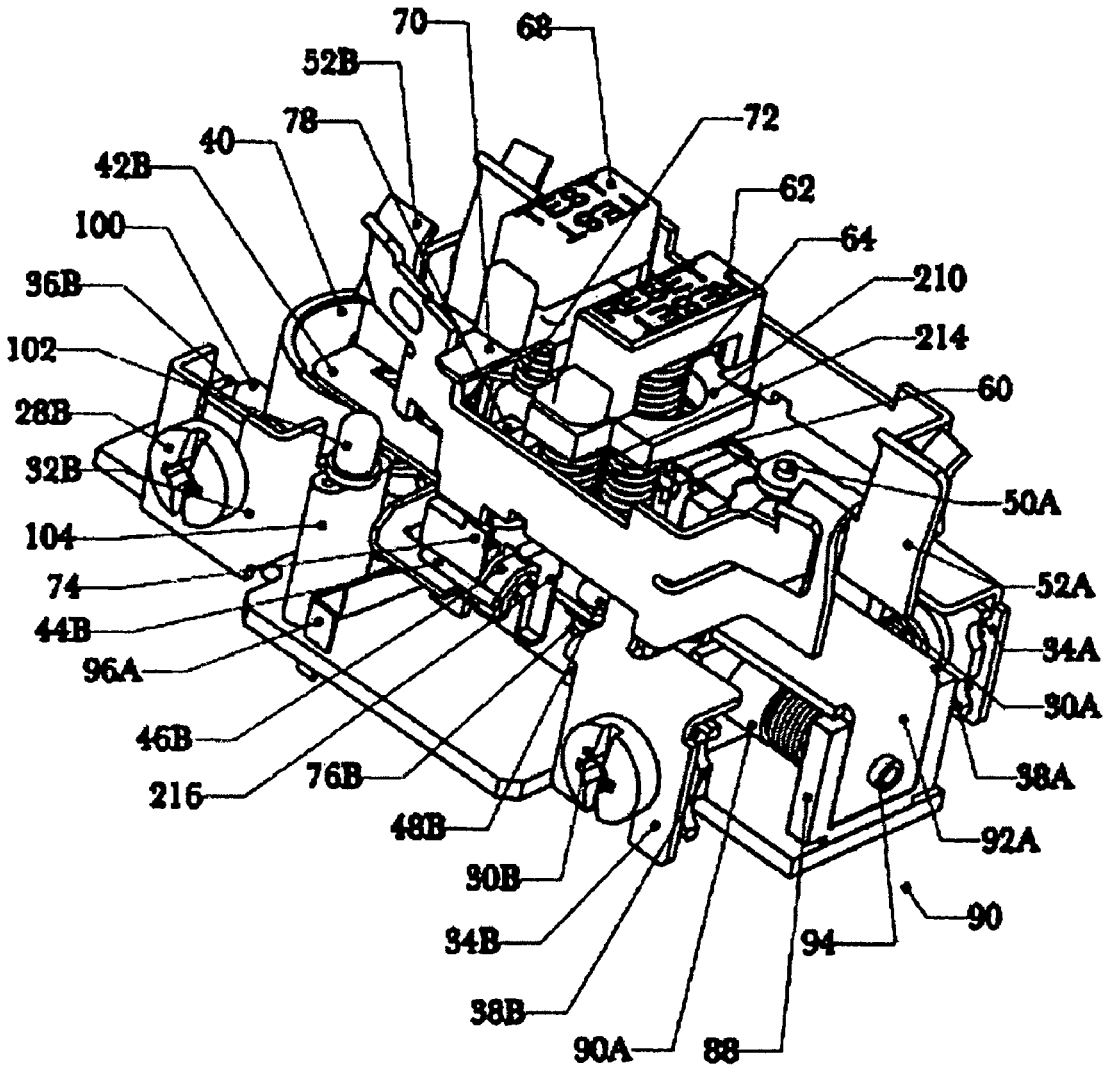
FIG. 6 is an assembly schematic of inner structure with printed circuit board of the GFCI depicted in FIG. 1.

FIG. 6 illustrates the inner structural view of one embodiment of the GFCI showing the structure of FIGS. 2 and 3 with face cover (10) (see FIG. 2) and back cover (14) (see FIG. 3) removed. A printed circuit board (100) is installed in the device. The printed circuit board includes the dual-color alarm indicator (102), the ground fault test circuit (4), and an auto-monitoring protective device connected to two input pins (116) of the solenoid (90).

The printed circuit board (100) has a ring magnet housing (40) (also known as a ring magnet transformer) mounted thereon and a pair of line conductive members (42A) (see also FIG. 8),(42B) with one end inserted into the ring magnet housing (40) and connected to the circuit of the line terminal wiring lugs (32A) (see FIG. 8),(32B). A pair of flexible wires (44A) (see FIG. 8),(44B) are welded to the upper end of the pair of line terminal conductive members (42A) (see FIG. 8),(42B). The other end of the pair of flexible wires (44A) (see FIG. 7),(44B) are connected to a pair of line terminal moveable contact arms (46A) (see FIG. 7),(46B), at each end of which are placed a pair of line terminal movable contacts (48A) (see FIG. 7) and a pair of line terminal movable contacts (48B) respectively. The pair of line terminal wiring lugs (32A) (see FIG. 8),(32B) and a pair of line terminal nuts (36A) (omitted for clarity),(36B) are secured together respectively by a pair of line binding screws (28A) (omitted for clarity),(28B). A pair of load terminal conductive members (34A) (see FIG. 8),(34B), a pair of load terminal binding screws (38A),(38B), and a pair of load terminal nuts (30A), (30B) are assembled together respectively and the two parts are disposed on each side of the printed circuit board.

The fixed frame (78) is installed on the circuit board (100). The moveable crosshead (84) connects to the fixed frame (78) by means of the return spring (118) in order to control the startup of the mechanical device and circuit. The moveable crosshead (84) contains the auxiliary switch moveable contact arm (96A). The auxiliary moveable contact (98A) is riveted to the auxiliary moveable contact arm (96A). The auxiliary switch fixed contact arm (96B) is connected to the circuit board (100). The auxiliary switch fixed contact (98B) is riveted to the auxiliary switch fixed contact arm (96B). Auxiliary switch fixed contact (98B) and auxiliary switch moveable contact (98A) form the auxiliary switch (96). The moveable crosshead, being connected to the reset button, causes auxiliary switch fixed contact (98B) and auxiliary switch moveable contact (98A) to touch when the reset button is depressed.

Located in the center of one embodiment of the circuit interruption device is a reset button (62), the reset pull rod (66) ringed by a reset spring (64), a reset guide board (210), two guide board springs (214), a reset push rod (212) (see FIG. 8) passing through the middle frame (12) (omitted for clarity), and the cone-shape head of the reset pull rod (66) (not shown) which passes through the aperture of a lifter(74). The reset pull rod (66) of the circuit interruption device is connected to the reset guide board (210) under the reset button (62). The load neutral contact-frame (52A) and phase contact-frame (52B) carrying load fixed contacts (54A),(54B), respectively, are disposed on the middle frame (not shown). A trip spring (60) is disposed between the center of the lifter (74) and middle frame (12) (see FIG. 7) to push the lifter (74) toward the back cover (14). The lifter (74) carries the first line moveable contact arm (46A) and the second line moveable contact arm (46B) which carry the first pair of line moveable contacts (48A) and the second pair of line moveable contacts (48B) respectively. Each end of the lifter (74) includes one aperture in which two pairs of balance springs (76A),(76B) are seated. The balance springs are also disposed beneath the line terminal movable arms (46A),(46B) respectively. Two moveable contact arms (46A), (46B) are hooked by the two moveable contact arm hooks (216) disposed on each side of the lifter (74), respectively. A metal member, consisting of a latch (80) and a latch spring (82) (see FIG. 10), passes through a traverse aperture in the lifter (74). Lifter (74) is able to move upwardly and downwardly within the center of a fixed frame (78). Lifter (74) moves upwardly if performing a reset operation and moves downwardly if the device trips. The fixed frame (78) is affixed to the printed circuit board (100) and is located under the lifter (74). A moveable crosshead (84) (see FIG. 10) is connected to a moveable gangplank (86) (see FIG. 10) in the fixed frame (78). A fixed contact arm (96B) on which is disposed a fixed contact (98B) (see FIG. 10) and an auxiliary moveable contact arm (96A) on which is disposed a moveable contact (98A) (see FIG. 10), are placed on the circuit board to compose the auxiliary switch (96) to control the power supply of the circuit. The dual-color LED (102) (capable of shifting between two colors) with three pins enclosed by a indication lamp housing (104) is soldered on the circuit board (100) and configured to provide the circuit devices with various alarm signals.

The solenoid (90), which is configured to actuate the circuit interrupter, comprises the solenoid bobbin (88), the plunger (94), and the fixed magnet (92A). The plunger (94) passes through the bobbin hollow core portion and is riveted to the fixed magnet (92A) on the back of the solenoid (90). The bobbin is surrounded by coil to form a solenoid. When there is current flowing through the line terminal, the solenoid functions as an electromagnet, and the plunger (94) produces magnetic force.

Figure 7:
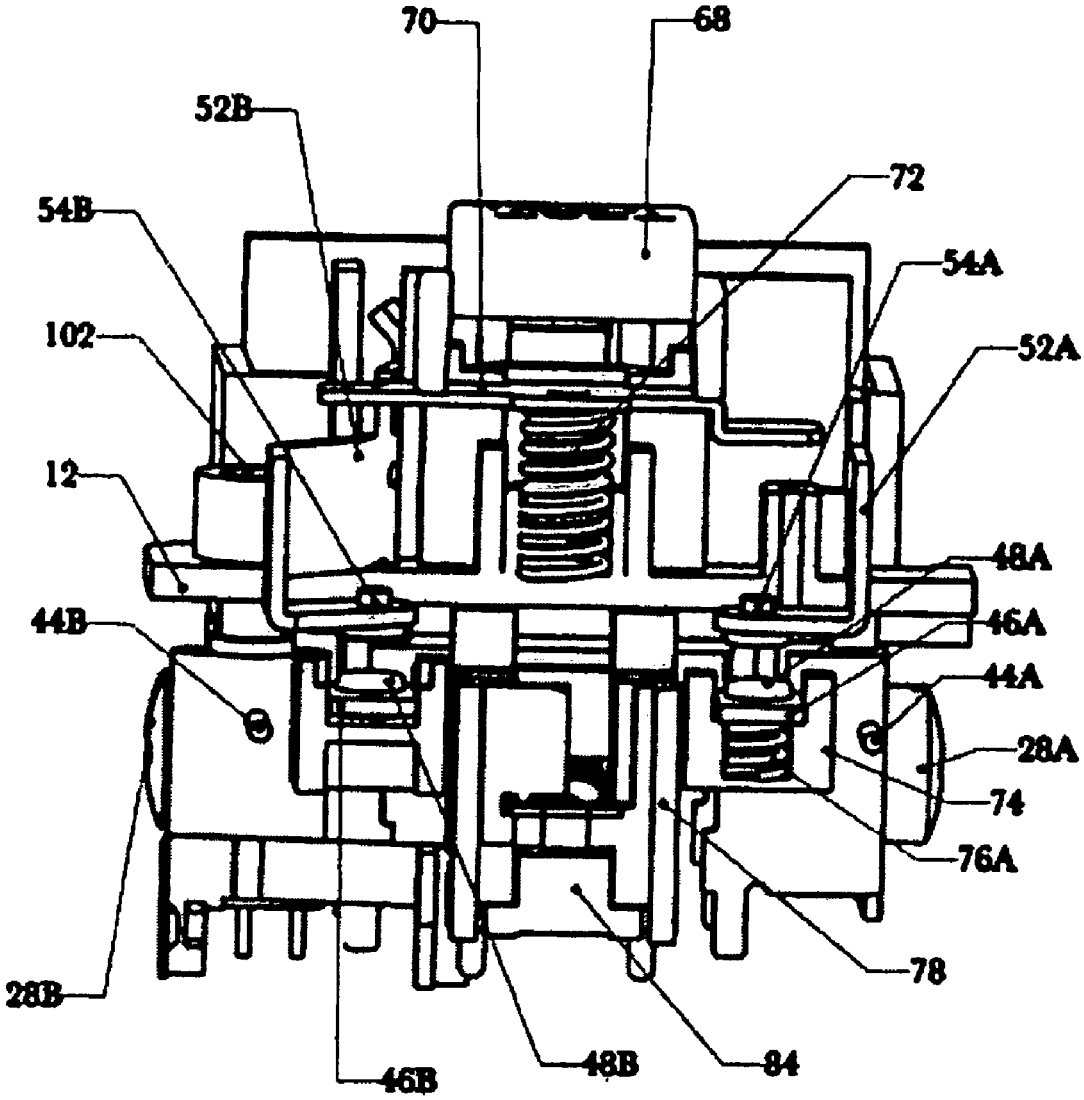
FIG. 7 is a cross section schematic of the device depicted in FIG. 6 in the tripped state.

FIG. 7 is a cross section schematic of the embodiment of the device depicted in FIG. 6 in the tripped state. The operating principle of the test button (68) is illustrated. Under the test button (68) is the test strip (70) which is disposed on top of the test spring (72). The two ends of the u-shape head of the test button (68) bear against the test strip (70). When the test button (68) is depressed, the test spring (72) is depressed to make one end of the test strip (70) touch the wall-pin of the load phase contact-frame (52B) and the other end to contact a small resistor connected to a conductive member (42A) (see FIG. 8) passing through the ring magnet transformer housing (40) (see FIG. 8), thus establishing a simulated fault signal. Releasing the test button (68), the reset spring (64) makes the test button (68) return to its original position to thereby determine if the GFCI is working under normal conditions.

Figure 8:
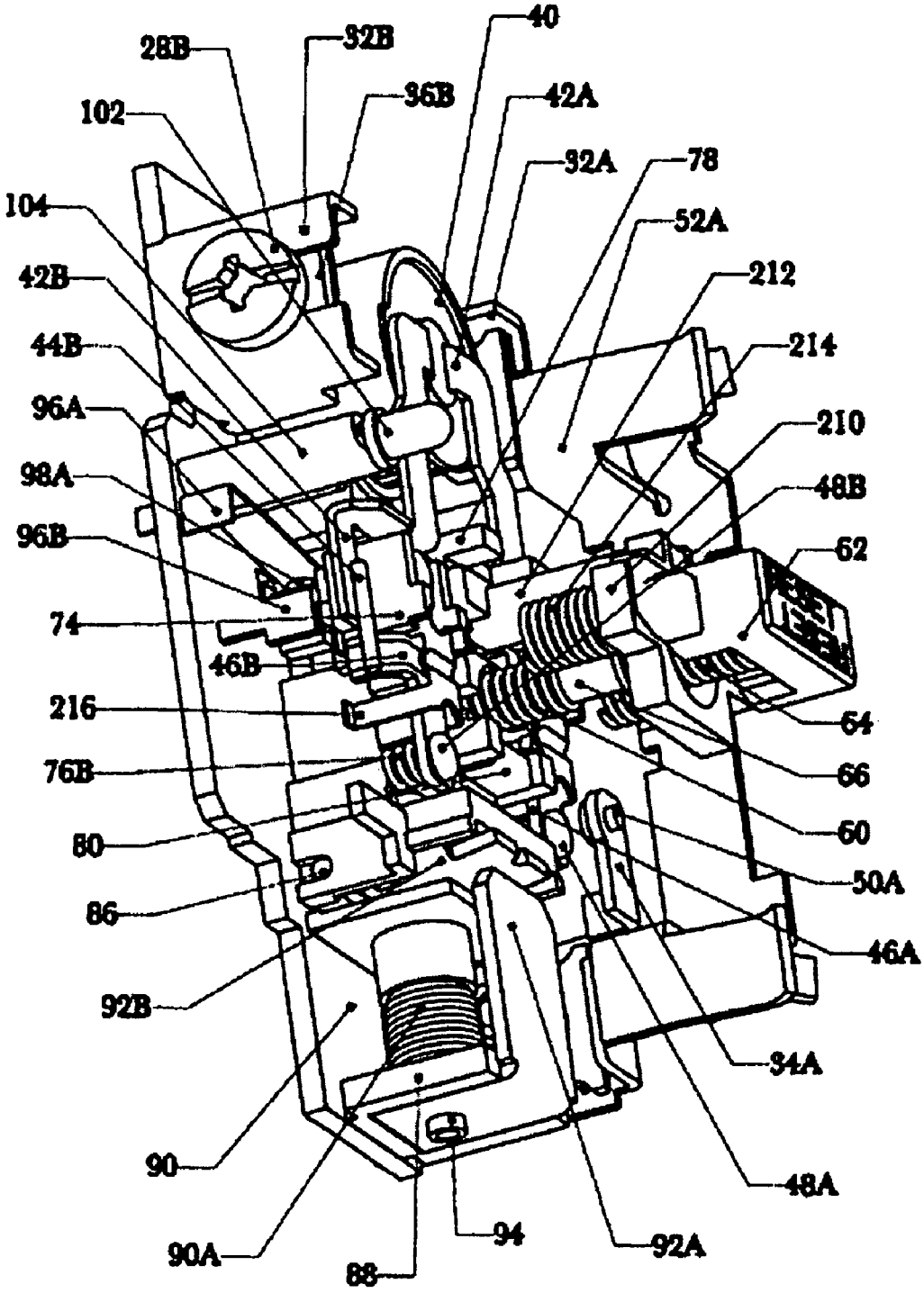
FIG. 8 is a perspective view of the device depicted in FIG. 6 in the tripped state.

FIG. 8 is a perspective view of the embodiment of the device depicted in FIG. 6 in the tripped state with test button (68) removed. The device is in tripped state before the GFCI is shipped out. The device includes the dual-color indication lamp (102). The auxiliary switch (96A),(96B) on the printed circuit board (100) is turned off. The fixed magnet (92A) and a moveable magnet (92B) on the solenoid (90) are in a separated state.

Figure 9:
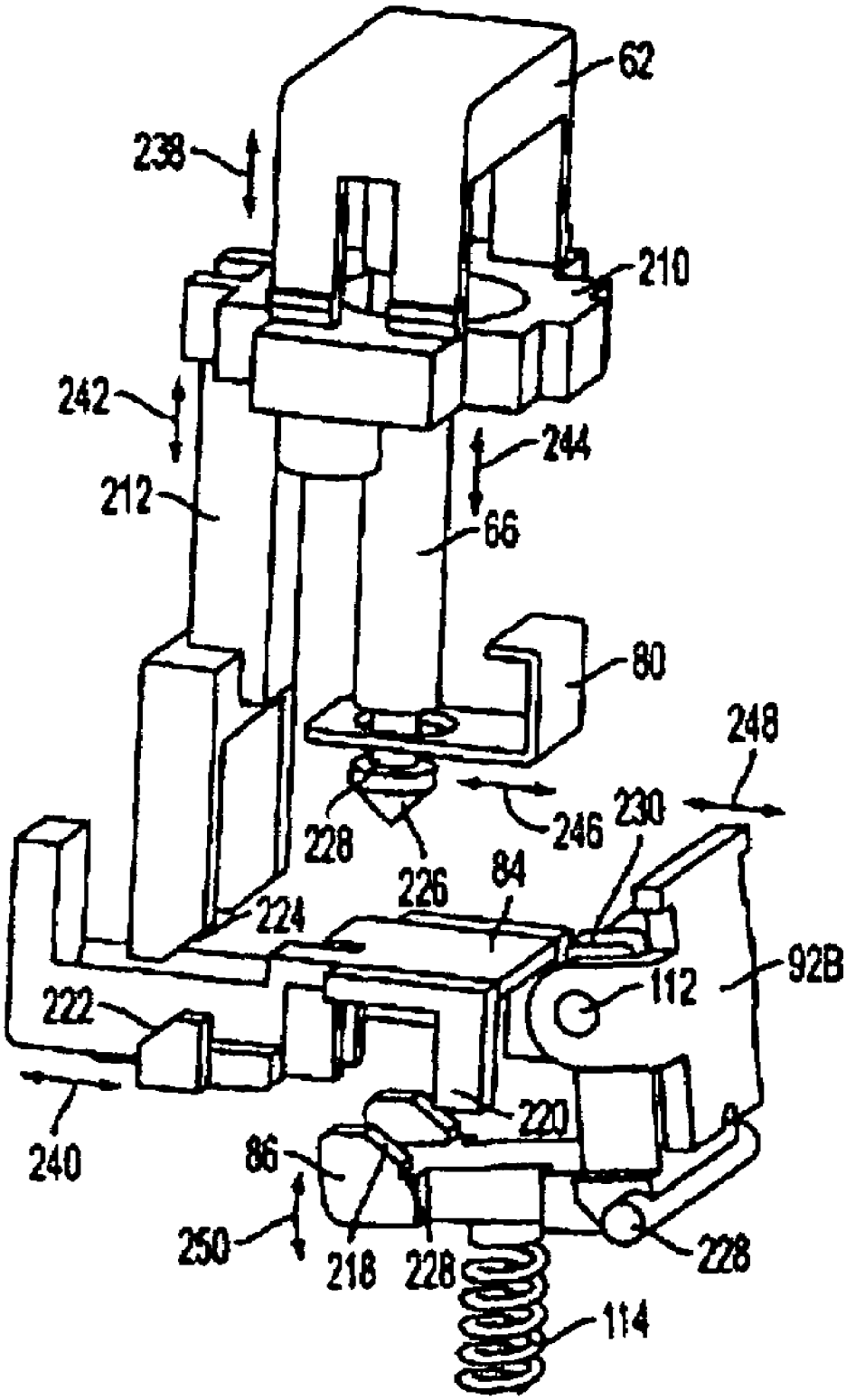
FIG. 9 illustrates an exploded partial perspective view of components to assist in explaining the operation of the GFCI.
Figure 10:
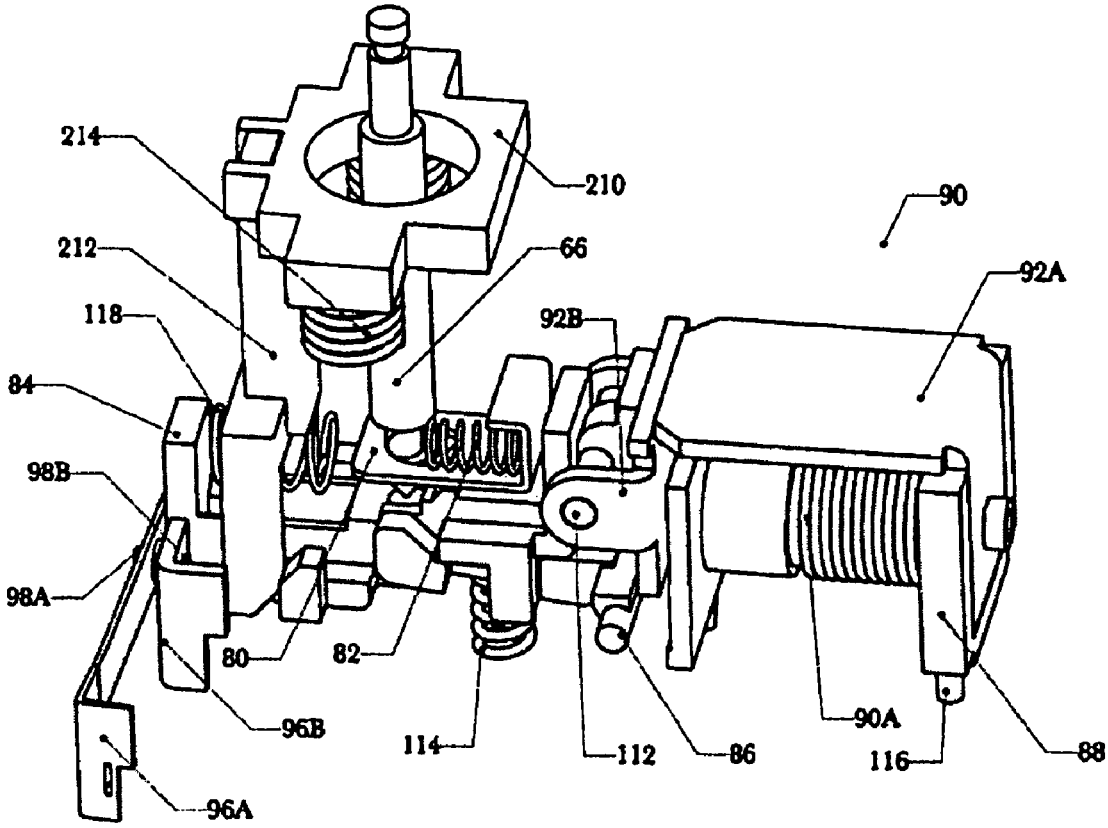
FIG. 10 shows the mechanical mechanism of the device in the reset state.

The reset-trip device will now be explained in relation of FIGS. 9 and 10. FIG. 9 illustrates a partial perspective view of components to assist in explaining the operation of the GFCI. FIG. 10 shows the mechanical mechanism of the device in the reset state. To the left of the solenoid (90) is a moveable gangplank (86) on which is disposed a pivotally mounted permanent magnet, also referred to herein as moveable magnet (92B). The moveable magnet (92B) and the moveable gangplank (86) are connected together by a lock pin (112). The gangplank spring (114) is disposed under the gangplank. The moveable gangplank (86), the lock pin (112) and the gangplank spring (114) form a body. When the gangplank spring (114) extends or contracts, the moveable gangplank pivots around a pivot point (228). This causes the moveable gangplank to move up and down along the path of directional arrow 250. As the moveable gangplank pivots the moveable magnet (92B) moves side-to-side along the path of directional arrow 248. Above the moveable crosshead (84), on which is disposed the return spring (118), is the metal latch (80) with the latch spring (82). The metal latch (80) passes through the aperture of the lifter (74) and is seated in the fixed frame (78) (see FIG. 13). The metal latch (80) has an aperture. As the latch spring extends and contracts the metal latch moves from side-to-side along the path of directional arrow 246. Above the metal latch (80), and configured to pass through the aperture of the metal latch (80), is a reset pull rod (66). The reset pull rod (66), which moves up and down along the path of directional arrow 244, is connected to the reset button (62) on one end and has a cone-shaped head (226) with a groove (228) on the other end. Located between the moveable gangplank (86) and the metal latch (80) is the moveable crosshead (84). A return spring (118) is connected between the moveable crosshead (84) and the fixed frame (78). When the return spring (118) extends or contracts the moveable crosshead (84) moves side-to-side along the path of directional arrow 240. Above the moveable crosshead (84) and beside the reset pull rod (66) is the reset push rod (212). The reset push rod (212) is connected to the reset button (62) and moves up-and-down along the path of directional arrow 242. The plurality of components connect to one another to compose a reset-trip device.

Figure 11:
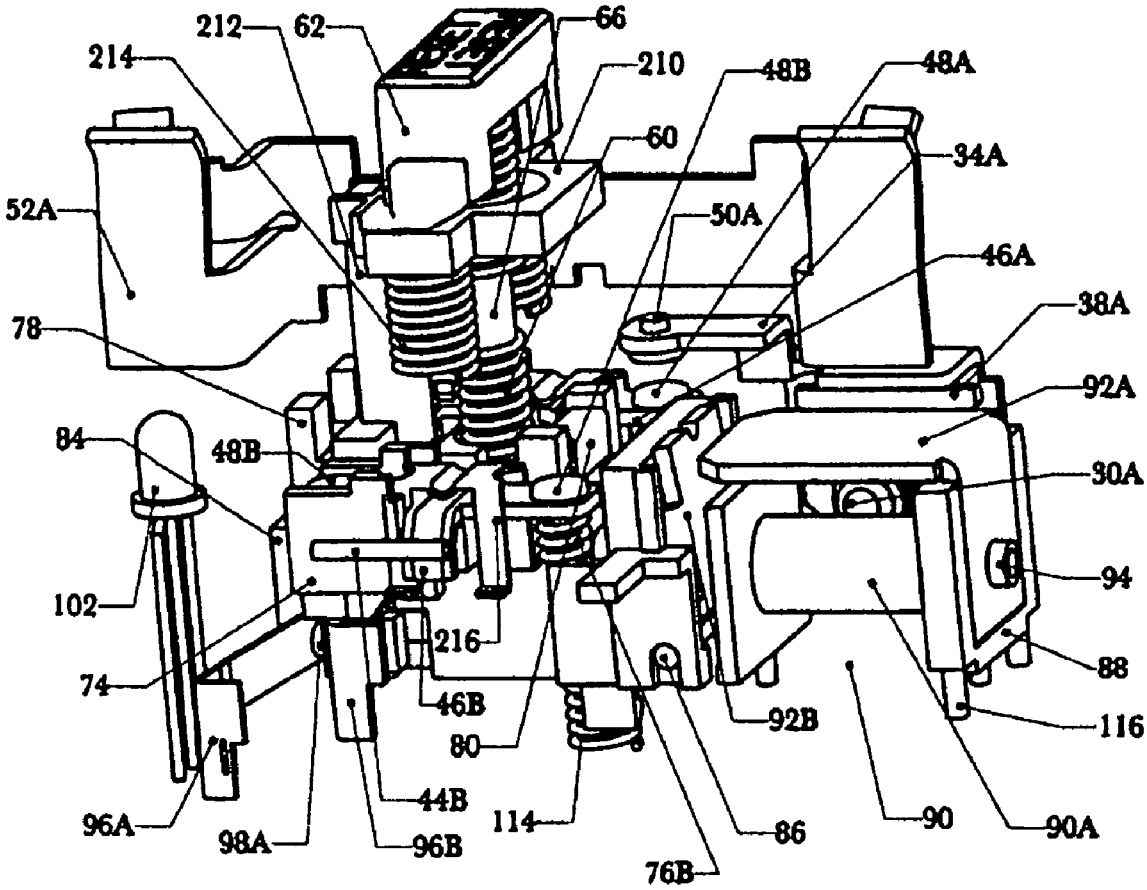
FIG. 11 is a perspective view of the circuit interruption device in the trip state.
Figure 12:
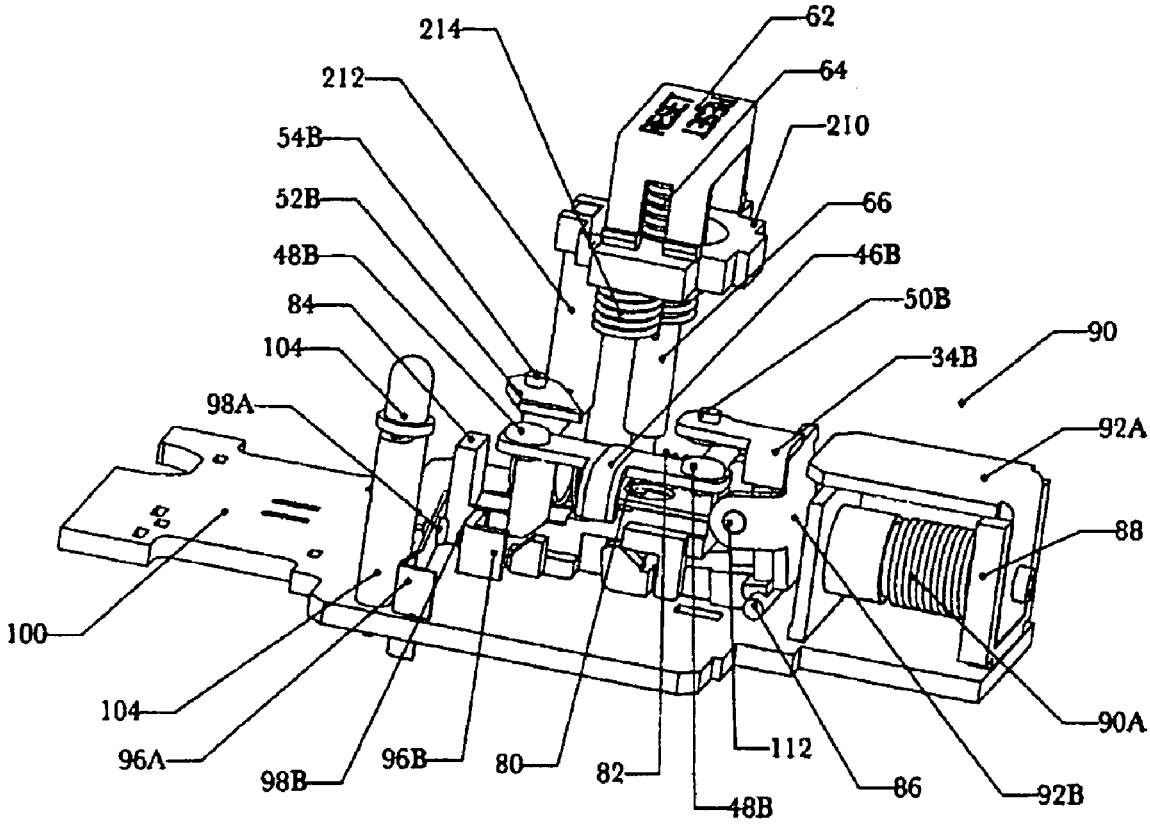
FIG. 12 is a perspective view of a mechanical implementation of the embodiment of the circuit interruption device of FIG. 10 in the trip state.

The trip state of the reset-trip device will now be explained in relation to FIGS. 9, 11, and 12. FIG. 9 illustrates a partial perspective view of components to assist in explaining the operation of the GFCI. FIG. 11 is a perspective view of the circuit interruption device in the trip state. FIG. 12 is a perspective view of a mechanical implementation of the embodiment of the circuit interruption device of FIG. 10 in the trip state. When in the trip state the reset spring (64) is fully extended forcing the reset button (62) into the up position toward the face cover (10). The reset push rod (212) and the reset pull rod (66), which are connected to the reset button (62), are also forced into the up position. The reset push rod (212) is separated from the moveable crosshead (84) and the reset pull rod (66) is separated from the aperture of the metal latch (80). The lifter (74) remains in the down position due to the force of the trip spring (60). The return spring (118) is fully extended forcing the moveable crosshead (84) to the left position. When in the left position, the moveable crosshead (84) forces the moveable contact arm (96A), on which is disposed a moveable contact (98A), away from the fixed contact arm (96B) on which is disposed a fixed contact (98B), thus opening the auxiliary switch. When the moveable crosshead (84) is pushed to the left by the return spring (118) the hook (220) on the moveable crosshead (84) is in contact with the sloped surface (218) on the moveable gangplank (86). This forces the moveable gangplank to remain in the down position, the gangplank spring (114) to compress, and the moveable magnet (92B) to remain in left position, away from the permanent magnet (92A).

When the device is in the tripped state and the metal latch (80) is out of engagement with the groove of reset pull rod (66), the first pair of line moveable contacts (48A) and the second pair of line moveable contacts (48B) separate from the first load fixed contact (54A) and the second load fixed contact (54B) of the neutral contact-frame (52A) and phase contact-frame (52B) respectively. The first pair of line moveable contacts (48A) and the second pair of line moveable contacts (48B) also separate from the first load fixed contact (50A) and the second load fixed contact (50B) of the first load conductive member (34A) and the second load conductive member (34B).

Figure 13:
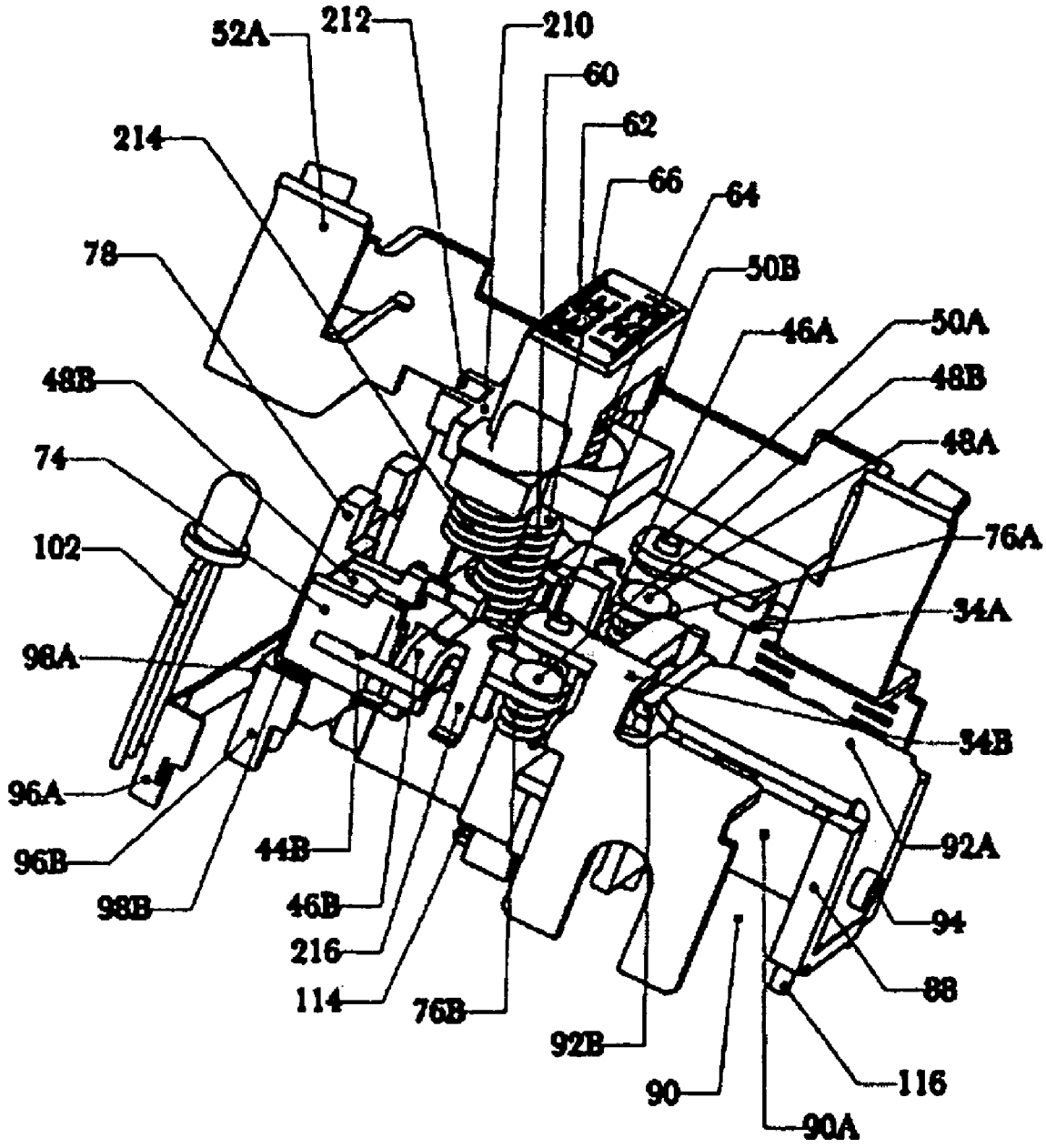
FIG. 13 is a perspective view of the device depicted in FIG. 8 in the reset state.
Figure 14:
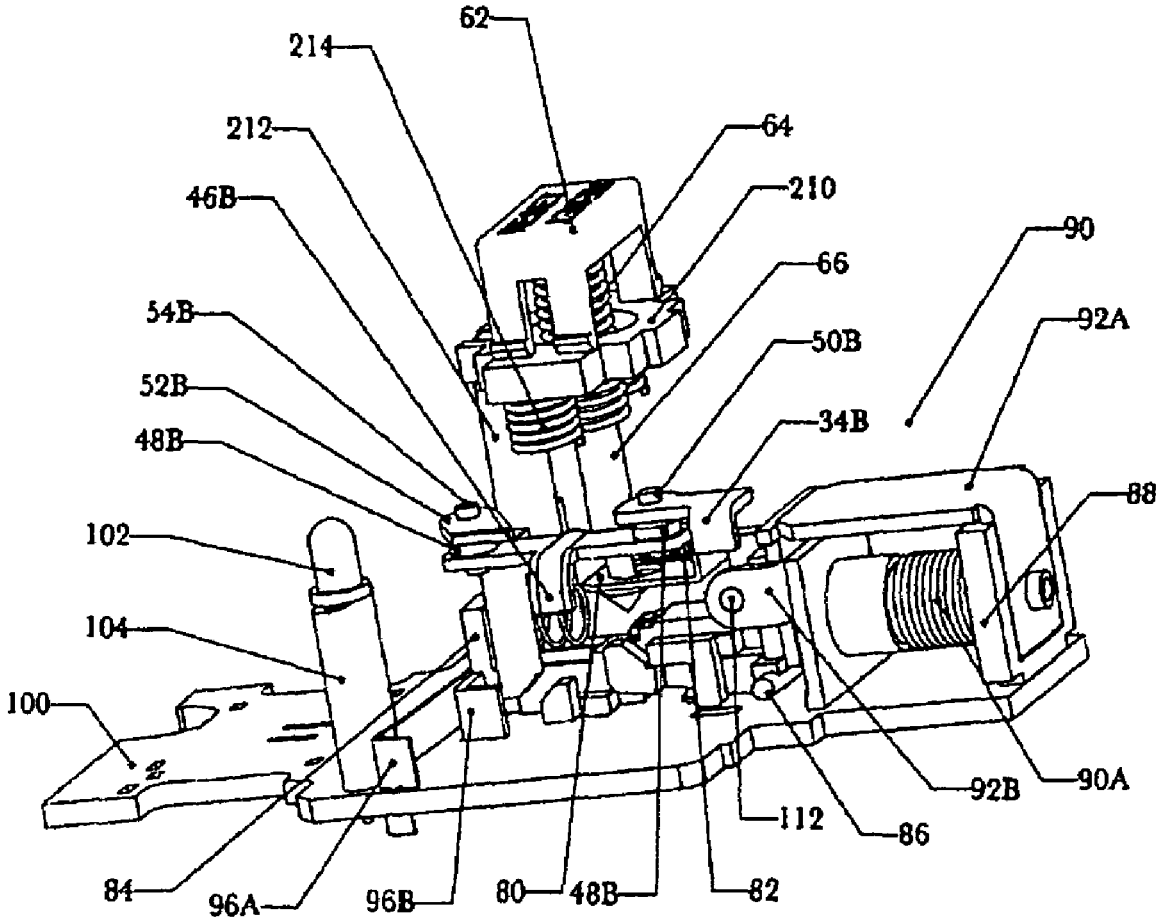
FIG. 14 is a prospective view of the mechanical implementation of the embodiment of the circuit interruption device of FIG. 10 in the reset state.

A reset operation will now be explained in relation to FIGS. 9, 13, and 14. FIG. 9 illustrates a partial perspective view of components to assist in explaining the operation of the GFCI. FIG. 13 is a perspective view of the device depicted in FIG. 8 in the reset state. FIG. 14 is a prospective view of the mechanical implementation of the embodiment of the circuit interruption device of FIG. 10 in the reset state. A newly installed GFCI is in the tripped state and therefore should be energized before operating. This is done by through a reset operation. To perform a reset operation the reset button (62) is depressed. This permits the entry of the cone-shaped head (226) of the reset pull rod (66) into the semi-elliptical aperture of the metal latch (80) (see FIG. 10) along the path of directional arrow 244. As the cone-shaped head (226) of the reset pull rod (66) is inserted into the aperture of the metal latch (80) the metal latch (80) is forced to the left along the path of directional arrow 246, thereby compressing the latch spring (82). Once the cone-shaped head (226) of the reset pull rod (66) passes through the metal latch the latch spring (82) moves the metal latch (80) to the right, the reset position, thereby engaging the groove (228) of the reset pull rod.

As the reset button (62) moves downward along the path of directional arrow 238, the slopped surface (224) of the reset push rod (212), which is connected to the reset button (62) and moves along the path of directional arrow 242, contacts the sloped surface (222) of the moveable crosshead (84). As the reset push rod (212) is pushed further down, the moveable crosshead (84) is moved to the right along the path of directional arrow 240 (see FIG. 9) and begins to compresses the return spring (118) (see FIG. 10). When the reset button (62) is fully depressed the reset push rod (212) will have fully pushed the moveable crosshead to the right along the path of the directional arrow 240 such that the return spring (118) is fully compressed. Once the moveable crosshead (84) moves far enough to the right the hook (220) on the moveable crosshead (84) will disengage the slopped surface (218) on the moveable gangplank (86). This will allow the gangplank spring (118) to extend and push the moveable gangplank (86) upward along the path of directional arrow 250. Pivoting around pivot point 228 the upper arm (248) of the moveable gangplank (86) will move the moveable magnet (92B) to the right, along the path of directional arrow 248, toward the fixed magnet (92A). When the gangplank spring (114) is in its extended position the moveable magnet (92B) comes into a proximity with the solenoid (90). Once the moveable crosshead (84) is moved to the right it forces the moveable contact arm (96A), on which is disposed a moveable contact (98A), into contact with the fixed contact arm (96B) on which is disposed a fixed contact (98B). This closes the auxiliary switch and enables all the components on the circuit board.

If there is power flowing through the GFCI the solenoid (90) creates a magnetic field and functions as an electromagnet, whereby the plunger (94) produces a magnetic force in the fixed magnet (92A). This magnet force will attract the moveable magnet (92B) and cause the moveable magnet (92B) to come into contact with the fixed magnet (92A). As the moveable magnet (92B) moves into contact with the fixed magnet (92A) the moveable gangplank (86) will pivot around pivot point 228 and move up along the path of directional arrow 250. As the moveable gangplank (86) moves with the moveable magnet (92B), the sloped surface (218) will force the moveable crosshead to the right along the path of directional arrow 240. As the moveable magnet (92B) and the fixed magnet (92A) come into contact, the moveable gangplank (86) (see FIG. 10) latches the hook (220) on the moveable crosshead (84) in groove 228 (see FIG. 10). This keeps the moveable crosshead (84) (see FIG. 10) from returning because the attraction force between the moveable magnet (92B) and the fixed magnet (92A) is greater than the force created by the return spring (118), which is pushing the moveable crosshead (84) to the left along the path of directional arrow 240. This holds the moveable magnet (92B) in place.

When the reset button is released, the reset spring (64) begins to extend thereby moving the reset pull (66) rod toward the up position. The reset pull rod (66) which has been latched by the metal latch (80) (see FIG. 10) draws the lifter (74) carrying two line terminal contact arms (46A),(46B) to move upwardly together, thus causing the two line terminal moveable contacts (48A),(48B), disposed on the line terminal contact arms (46A),(46B), to connect with the pair of fixed contacts (54A),(54B) (see FIG. 7) on the load neutral contact-frame (52A) (see FIG. 8) and load phase contact-frame (52B)

(see FIG. 5). A pair of line moveable contacts (48A),(48B) are connected to a pair of load fixed contacts (50A),(50B) (see FIG. 5) on the line terminal conductive members (34A), (34B). As it is very difficult for 4 pairs of contacts to contact one another respectively, two pairs of balance springs (76A), (76B) (see FIG. 13) are disposed in the apertures at both ends of the lifter (74) and under the pair of line terminal moveable contact arms (46A),(46B), which contain the line moveable contacts (48A), (48B), to adjust and balance the contact pressure. After the reset operation has been conducted, the normally operating GFCI dual-color indication lamp glows green to indicate the GFCI is in good working order.

A trip operation will now be explained in relation to FIGS. 9, 11, and 12. FIG. 9 illustrates a partial perspective view of components to assist in explaining the operation of the GFCI. FIG. 11 is a perspective view of the circuit interruption device in the trip state. FIG. 12 is a perspective view of a mechanical implementation of the embodiment of the circuit interruption device of FIG. 10 in the trip state. If the GFCI is in the reset state and a ground fault or external power-failure fault occurs, or if any of the main inner components (including solenoid (90)) result in a short or open circuit, the solenoid (90) stops operating immediately. Once the solenoid (90) stops operating, the magnetic force of plunger (94) disappears which in turn releases the moveable magnet (92B). The return spring (118) (see FIG. 10) on the moveable crosshead (84) extends, which makes the moveable crosshead (84) move to the left along the path of directional arrow 240 thereby returning it to the original trip position. This causes the hook 220 of the moveable crosshead (84) to engage the sloped surface (218) of the moveable gangplank (86) and force the moveable gangplank down along the path of directional arrow 250. As the moveable crosshead moves down it pivots around pivot point 228 and the upper arm 230 of the moveable crosshead pushes the metal latch (80) to the left, along the path of directional arrow 246, such that the latch spring (82) is depressed (see FIG. 10). This causes the metal latch (80) to disengage the groove 228 of the reset pull rod (66) which allows the reset spring (64) (see FIG. 13) to re-extend, along the path of directional arrow 238 and, in turn, prop the reset button (62) up to the trip position. Simultaneously, the reset pull rod (66) moves up, along the path of directional arrow 244, and the reset push rod (212) moves up, along the path of directional arrow 242.

During the trip operation, the trip spring (60) extends to depress the lifter (74) such that the two pairs of line moveable contacts (48A) (see FIG. 7),(48B) on the two line moveable contacts arms (46A),(46B), which are disposed on the each side of the lifter (74), separate from the two load fixed contacts (54A),(54B) (see FIG. 7) and the load conductive member and the load fixed contacts (50A),(50B) (see FIG. 13) to thereby cut the power supply. The moveable crosshead (84) pushes the moveable contact arm (96A) of the auxiliary switch (96) and opens the auxiliary switch (96A),(96B) when it returns, thus shutting off the power supply to the circuit board preventing current from occurring on the components of the circuit board.

When the dual-color indication lamp goes out the reset button (62) is non-resettable when attempting to restart the device by depressing the reset button (62) only in the case of external power-failure fault. The GFCI can be reset by pressing the reset button (62) when the power supply resumes. The device is available for use after the dual-color indication lamp (102) glows green. If the reset operation fails, the GFCI should be replaced.

Figure 15:
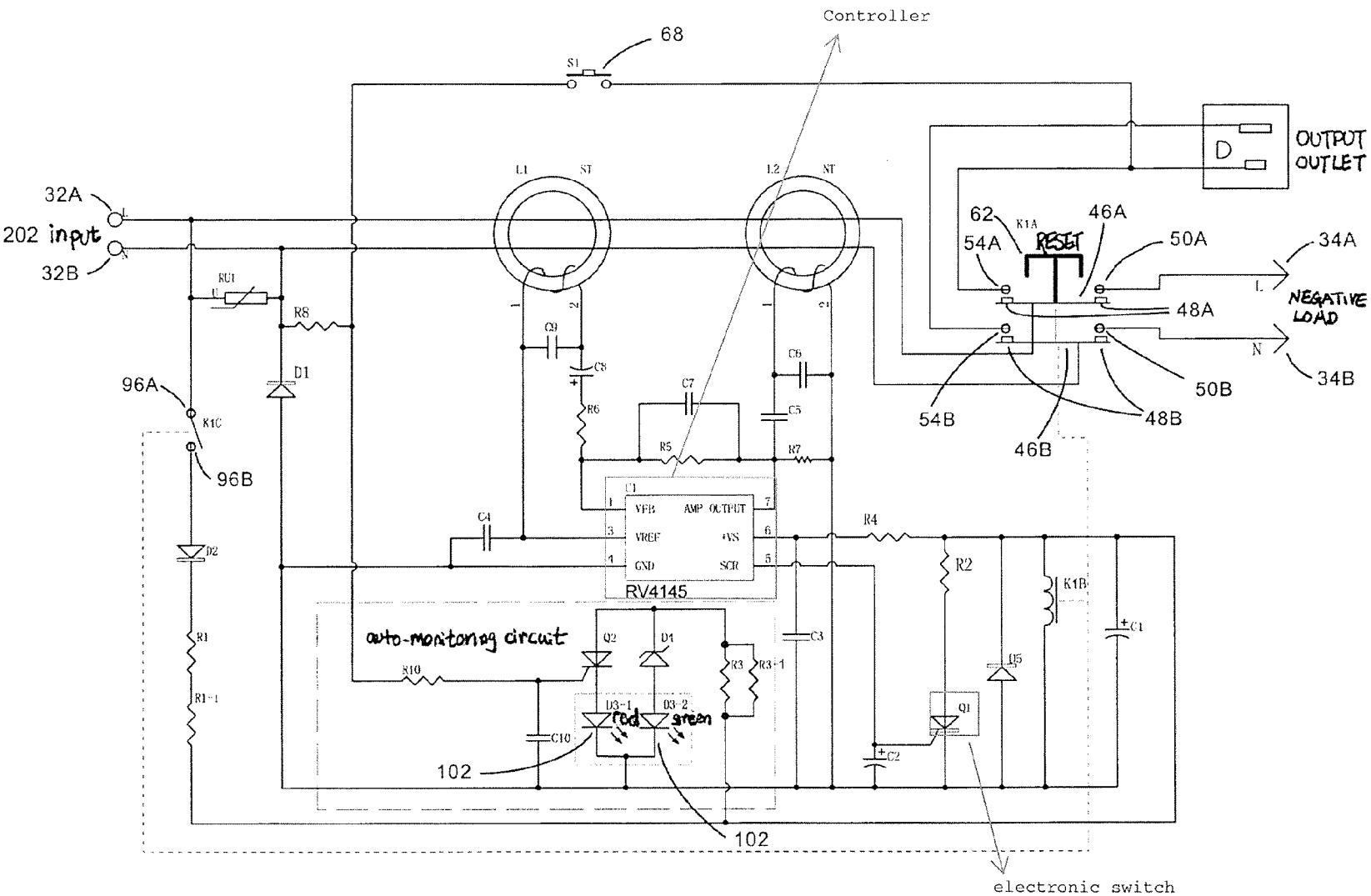
FIG. 15 is a circuit principle diagram of the device depicted in FIG. 1.

FIG. 15 illustrates the ground fault test circuit module (4) and the end-of-life fault detection circuit (5) of one embodiment of the circuit interruption device having the function of auto-monitoring and multi-protecting. The device possesses a unique inner circuit monitoring alarm system and multi-protection function in addition to having the ability to interrupt a ground fault circuit and a reverse miswiring, thus ensuring the user's safety. FIG. 14 also shows the visual indication color-changing alarm circuit which includes a auto-monitoring circuit, a zener diode, an SCR, the solenoid (90), resistors, and the dual-color indication lamp (102).

Referring to FIG. 15, one path of pin 1 on the integrated block U1 is connected to one end of parallel resistor R5 and capacitor C7. The other path is connected to pin 2 of the differential signal transformer L1 through the series resistor R6 and capacitor C8.

One path of pin 3 is connected to pin 1 of differential signal transformer L1 while the other path is connected to pin 4 through capacitor C4. A capacitor C9 is connected in series between pin 1 and pin 2 of differential signal transformer L1.

One path of pin 4 is coupled to the anode of diode D1. The other path is coupled to one end of capacitor C10, one end of the dual-color indicator (102) which consists of light emitting diode indicator D3-1 and D3-2, one end of capacitor C3, pin 2 of differential signal transformer L2, one end of the polar capacitor C2, one end of the SCR Q1, the anode of diode D5, one end of the transformer K1B and one end of the variable capacitance C1.

Pin 5 is coupled to the other end of polar capacitor C2 through one end of SCR Q1.

Pin 6 is connected to capacitor C3 and, through resistor R4, to one end of series resistor R2 and SCR Q1, the cathode of diode D5, the other end of transformer K1B and the other end of polar capacitor C1.

Pin 7 is connected to Pin 1 of differential signal transformer L2 through capacitor C5, a resistor R7 is connected in series between capacitor C5 and differential signal transformer L2, a capacitor C6 is connected in series between Pin 1 and Pin 2 of differential signal transformer L2.

The series LED indicator D3-1 and SCR Q2 are connected in parallel to series LED indicator D3-2 and diode D4, and then coupled in parallel to the node of parallel resistor R3 and resistor R3-1, one path of the parallel resistor R3 and resistor R3-1 is coupled to a pin on the solenoid (90), the other path is connected to switch K1C through series R1-1, R1, diode D1, one end of SCR Q2 is connected to one end of S1 test button (68) through resistor R10, the other end of test button (68) is connected to the outlet.

Live wire L is connected to switch K1C, one end of the switch K1C is connected to the auxiliary switch fixed contact arm (96B), the other end of the switch K1C is connected to the auxiliary switch moveable contact arm (96A).

Line terminal (202) live wire L is connected to a first line wiring lug (32A). Line terminal (202) neutral wire N is connected to a second line wiring lug (32B), line terminal (202) live wire L and line terminal (202) neutral wire N are connected to each terminal of reset switch (62) K1A after passing through differential signal transformer L1 and differential signal transformer L2. Each terminal of reset switch (62) K1A is connected to the first load fixed contact (50A), the second load fixed contact (50B), the first line moveable contact arm (46A) the first pair of moveable contacts (48A), the second line moveable contact arm (46B), the second pair of moveable contacts (48B), the first load fixed contact (50A), the second load fixed contact (50B), and the reset button (62). The first load fixed contact (50A) and the second load fixed contact (50B) are connected to the first load conductive member (34A) and the second load conductive member (34B)

respectively. The first load fixed contact (54A) and the second load fixed contact (54B) are connected to the output.

The circuit depicted in FIG. 15 functions as follows:

If the commutation diode D2 or D1 opens, or the dropping resistor R1 or R1-1 opens, or the solenoid coil (90) in the circuit shorts out or opens, the two ends of the solenoid (90) will lose potential and magnetic force. This will trip the GFCI and turn auxiliary switch (96) off. If the SCR shorts out, the potential at the two ends of the solenoid (90) is absorbed by the short point, making the solenoid (90) lose potential and magnetic force. This will also trip the GFCI and turn the auxiliary switch (96) off thus preventing the further use of unprotected power. This ensures the absolute safety of people and connected electrical appliances.

To ensure the normal operation of the GFCI, depressing the test button every 25 days is suggested in order to verify the GFCI is in good order. If the device does not trip to cut the power supply, GFCI provides a visual alarm indication to communicate to the user that the GFCI has reached the end of its useful life. If the indication lamp glows green the GFCI is under normal operation condition. If the indicator goes out it indicates the test was successful and the GFCI is safe to use. If the indication lamp glows red it means that the GFCI has reached the end of its life.

In case the resistor R4 opens or integrated block U1 opens or differential signal transformer L1 opens or shorts out and the test button (68) is depressed, an end-of-life simulated fault signal is produced. If the pin of the integrated block U1 receives no differential signal due to the short or open of the components noted above, in a predetermined period of time the integrated block U1 will have no signal output and will be unable to conduct SCR Q1. The solenoid will remain at high potential, preventing the GFCI device from tripping, and the test signal will actuate the gate of SCR Q2 through the current-limiting resistor R10 thus causing SCR Q2 to conduct. Because the anode pin of SCR Q2 and the cathode pin of the Zener diode D4 are connected and the cathode pin of SCR Q2 is connected to the anode pin of the dual-color LED D3-1, the test signal makes the potential of the cathode pin of diode D4 drop through the anode pin of SCR Q2, which makes D4 cut the current to D3-2 and turn off the green light of D3-2. At the same time this makes LED D3-1 glow red to thereby provide an alarm indication through the anode pin of SCR Q2 to communicate to the user the GFCI has reached end of its life and should be replaced.

What is claimed is:

1. A circuit interruption device, comprising:

an input for receiving AC power;

an AC socket electrically coupled to the power input;

a reset switch having an open and a closed position, which electrically couples the power source to the AC socket, the reset switch including a reset button to move the reset switch between the open and closed positions, the reset switch being biased in the open position and comprising a first set of electrical contacts electrically coupled to the power input and a second set of electrical contacts, electrically coupled to the AC socket;

a controller, coupled to the power input, and producing an output voltage in response to a change in current at the power input;

a stationary electromagnet coupled to the input and to the controller;

an electronic switch connected to the electromagnet and the controller which can receive the output voltage from the controller and turn off the electromagnet;

a pivotally mounted permanent magnet having a first and a second position, the first position of the pivotally mounted magnet being apart from the electromagnet, the second position of the pivotally mounted magnet being in contact with the electromagnet, the pivotally mounted magnet being placed into the first position or the second in response to the presence or absence of a magnetic field generated by the electromagnet; and a mechanical connection connecting the pivotally mounted permanent magnet to the reset button such that the permanent magnet's first position corresponds to the reset switch's open position and the permanent magnet's second position corresponds to the reset switch's closed position and further comprising a reset push rod connected to the reset button and having a first position and a second position that correspond to the open position and the closed position of the reset switch;

a lifter having an aperture and a first and a second position that correspond to the open position and the closed position of the reset switch, the lifter being biased in the first position;

a latch, connected to the lifter and passing through the aperture of the lifter, and having an aperture, a first position and a second position that correspond to the open position and the closed position of the reset switch, the latch being biased in the first position; and a reset pull rod connected to the reset button, configured to pass through the aperture of the lifter and the latch, having a cone shaped tip and a groove, located above the cone shaped tip, and having a first position and a second position that correspond to the open position and the closed position of the reset switch, the reset pull rod being configured to engage the latch such that the lifter is moved to the second position when the reset button is in the second position;

wherein the first set of electrical contacts are connected to the lifter; and the second set of electrical contacts are located in proximity to the lifter such that the first set of electrical contacts and the second set of electrical contacts touch when the lifter is in the second position.

2. The circuit interruption device in claim 1, wherein the pivotally mounted magnet is biased in the first position.

3. The circuit interruption device in claim 2, wherein the pivotally mounted magnet is biased in the first position by at least one return spring.

4. The circuit interruption device in claim 1, wherein the electromagnet comprises a solenoid including a solenoid bobbin surrounded by a coil electrically connected to the power input, the bobbin having a back end and a hollow bobbin core, the solenoid further including a fixed magnet attached to the back end and a plunger fixedly connected to the fixed magnet, wherein with current flowing through the coil surrounding the bobbin, the plunger and the fixed magnet become magnetized whereby the solenoid functions as an electromagnet and holds the pivotally mounted permanent magnet against the plunger and if no current flows through the coil, the solenoid releases the pivotally mounted permanent magnet.

5. The circuit interruption device in claim 1, further comprising a first indication lamp connected in electrical parallel with the controller and electromagnet such that the first indication lamp is illuminated while current flows through the device.

6. The circuit interruption device in claim 1, further comprising a test circuit, including a test button which, when depressed, simulates a ground fault.

7. The circuit interruption device in claim 6, further comprising: a first indication lamp, connected in electrical parallel with the controller and electromagnet such that first indication lamp is illuminated while current flows through the device; and a second indication lamp, connected to the test circuit and arranged in electrical parallel with the controller and electromagnet such that the second indication lamp is illuminated and the first indication lamp ceases to be illuminated if the device fails a simulated ground fault test, thereby indicating an end of life of the circuit interruption device.

8. The circuit interruption device of claim 1, wherein the reset switch further comprises a pair of contacts electrically coupling the AC socket to the power input, the contacts including at least one moveable contact and at least one spring mounted moveable contact, and mechanically coupled to the reset button to adjust and balance contact pressure between the pair of contacts.

9. The circuit interruption device of claim 1, further comprising a spring coupled to the reset button to bias the reset switch in the open position.

10. The circuit interruption device of claim 1, wherein the mechanical connection further comprises:

a moveable crosshead configured to receive the reset push rod and move between a first position and a second position, that correspond to the open position and the closed position of the reset switch, respectively, the moveable crosshead being biased in the first position; and a moveable gangplank configured to receive the moveable crosshead and move between a first and a second position that correspond to the open position and the closed position of the reset switch, respectively, the moveable gangplank being biased in the first position when the crosshead is in the first position and the moveable gangplank being biased in the second position when the moveable crosshead is in the second position;

wherein the pivotally mounted permanent magnet is attached to the moveable gangplank such that the pivotally mounted permanent magnet comes into contact with the electromagnet when the moveable gangplank is in the second position, whereby the electromagnet, in the on state, holds the pivotally mounted permanent magnet in the second position and, in the off state, permits the crosshead to return to the first position.

11. The circuit interruption device of claim 10, wherein the lifter further comprises:

at least one spring to balance the contact pressure between the first and second set of electrical contacts.

12. The circuit interruption device in claim 10, further comprising an auxiliary switch mechanically coupled to the crosshead, having an open and closed position, and electrically connected between the power source and the controller such that the auxiliary switch is placed in the closed position when the reset button is pressed and stays in the closed position only when a magnetic field is generated by the electromagnet.

13. The circuit interruption device in claim 7, wherein the first indication lamp glows green to indicate normal operating condition.

14. The circuit interruption device in claim 13, wherein the first indication lamp goes out to indicate a successfully conducted test.

15. The circuit interruption device in claim 7, wherein the simulated ground fault test fails if the end-of-life fault test circuit and the circuit interruption device circuit fail to respond to a simulated fault signal in a predetermined period of time, and the second indication lamp glows red to indicate the failed simulated fault test and the end of life for the circuit interruption device.

* * * * *